United States Patent [19]

Kanies

[11] Patent Number: 4,710,107

[45] Date of Patent: Dec. 1, 1987

[54] SWASHBLOCK LUBRICATION IN AXIAL PISTON FLUID DISPLACEMENT DEVICES

[75] Inventor: Kerry R. Kanies, Hubertus, Wis.

[73] Assignee: The Oilgear Company, Milwaukee, Wis.

[21] Appl. No.: 852,348

[22] Filed: Apr. 15, 1986

[51] Int. Cl.[4] ..... F04B 1/12; F04B 27/03; F01M 11/00

[52] U.S. Cl. ..... 417/269; 91/486; 91/506; 184/6.28

[58] Field of Search ..... 417/222, 269; 91/486, 91/506; 92/54, 57, 152; 184/6.28

[56] References Cited

U.S. PATENT DOCUMENTS

| | | | |
|---|---|---|---|
| 2,455,330 | 11/1948 | Denison, Jr. | 91/486 |
| 2,570,698 | 10/1951 | Monseau | 184/6.28 |
| 2,871,798 | 2/1959 | Thoma | 103/162 |
| 2,929,551 | 3/1960 | Heidorn | 184/6.28 |
| 3,682,044 | 8/1972 | Ankeny et al. | 91/487 |
| 3,779,137 | 12/1973 | Kolvunen | 91/489 |
| 3,898,917 | 8/1975 | Adams et al. | 91/488 |
| 3,967,541 | 7/1976 | Born et al. | 91/506 |
| 4,142,452 | 3/1979 | Forster et al. | 91/506 |
| 4,449,444 | 5/1984 | Forster | 417/222 |
| 4,543,876 | 10/1985 | Heyl et al. | 417/222 |

FOREIGN PATENT DOCUMENTS

| | | | |
|---|---|---|---|
| 1900965 | 6/1970 | Fed. Rep. of Germany | 91/499 |
| 3232363 | 3/1983 | Fed. Rep. of Germany | 417/269 |
| 3232397 | 3/1983 | Fed. Rep. of Germany | 417/269 |

*Primary Examiner*—A. Michael Chambers
*Attorney, Agent, or Firm*—Quarles & Brady

[57] ABSTRACT

A variable displacement axial piston device has a movable swashblock, the front face of which is engaged by shoes pivotally mounted on the end of pistons operating in a plurality of cylinders formed in a cylinder barrel. The rear of the swashblock has a pair of arcuate bearing surfaces and a support is provided in the device for such bearing surfaces. A pair of arcuate bearings are disposed between the support and the swashblock bearing surfaces. At least the one swashblock bearing surface that is opposite the high pressure port of the device has a continuous groove that faces the respective bearing. A passageway is formed internal of the swashblock and terminates in the groove. An opening with an orifice is provided in the front face of the swashblock leading to the passageway from a position that is axially aligned with the one bearing surface and in the path of the shoes as they pass over the front face of the swashblock. The pistons and shoes have cooperating passages that lead from the cylinder to the front face of the swashblock. A small, controlled amount of fluid from the passages in the pistons and shoes will be pumped into the opening, through the orifice and into the passageway to deposit fluid in the groove to lubricate the bearing.

6 Claims, 5 Drawing Figures

SWASHBLOCK LUBRICATION IN AXIAL PISTON FLUID DISPLACEMENT DEVICES

BACKGROUND OF THE INVENTION

This invention relates to variable displacement axial piston fluid devices, such as pumps or motors, and particularly to a system for lubricating the bearing support surfaces of an adjustable position swashblock used in such devices.

One type of variable displacement axial piston pump or motor uses a shaft mounted rotating barrel having a plurality of parallel cylinders each containing a piston. The pistons each mount a shoe at one end that rides against a flat surface of a swashblock. The swashblock is movable so that the surface can be positioned at an angle to a plane normal to the axis of rotation of the barrel. As the barrel is rotated, the pistons reciprocate within the cylinders and the shoes slide over the angled swashblock surface. The angle of the surface will determine the volume displaced by each piston. When the barrel of a pump is rotated, fluid is drawn in through a low pressure port and is pumped out of a high pressure port. When fluid under pressure is pumped into the high pressure port, the barrel will be rotated so that the device will function as a fluid motor.

The swashblock is either mounted on trunnions or it has its rear face formed as a portion of a circular cylinder that mates with a similarly curved support. In the later case, the mating surfaces of the swashblock and its support are subjected to large forces transmitted through the pistons and shoes as the cylinders are exposed to the high pressure port. Often the mating surfaces of the swashblock and its support are metal-to-metal and this large force causes a great amount of friction that must be overcome to pivot the swashblock to adjust the displacement of the pump. The conventional solution has been to supply fluid under high pressure to the interface between the swashblock and its support either by use of an exterior high pressure line that leads from the high pressure port to the interface (U.S. Pat. No. 3,682,044) or by pumping high pressure fluid through passages in the pistons, the shoes and the swashblock to the interface (U.S. Pat. No. 3,898,917). In either case, the result is that high pressure fluid is pumped to the interface between the swashblock and the support to create a counterbalancing force.

Another approach interposes a bearing material between the mating surface and the support and the fluid within the pump housing is relied upon to lubricate the bearing. However, under high forces the bearing aligned with the high pressure port may be subjected to such a high axial force that the lubricating fluid will migrate away from the area of greatest stress and the bearing becomes dry. If this occurs, the force required to pivot the swashblock can rise to an unacceptable level.

The present invention provides a system to insure the delivery of lubricating fluid to a bearing over the entire bearing surface of the swashblock.

SUMMARY OF THE INVENTION

The invention involves improvements in a variable displacement fluid device that includes a housing with a high pressure port and a low pressure port. A rotatable cylinder barrel is journaled in the housing and includes a plurality of cylinders each having a piston that pivotally mounts a shoe that slides over a front face of a swashblock. The pistons and shoes have cooperating passages that lead from the cylinder to the front face of the swashblock to provide fluid from the cylinders to lubricate the front face of the swashblock. The swashblock has a pair of rear arcuate bearing surfaces. A support is provided in the housing for the swashblock bearing surfaces. A pair of arcuate bearings are disposed against the support and are engaged by the swashblock bearing surfaces. Means are provided for pivoting the swashblock over the surface of the bearings to vary the angle of the front face of the swashblock. The invention involves improvements to the swashblock such that the one swashblock bearing surface that is opposite the high pressure port is formed with a continuous groove that faces the respective bearing, a passageway is formed internal of the swashblock and terminates in the groove, and an opening with an orifice is provided in the front face of the swashblock leading to the passageway from a position that is axially aligned with said one bearing surface and in the path of the shoes.

With this system, a small, controlled amount of fluid from the passages in the pistons and shoes will be pumped into the opening, through the orifice, and into the passageway to deposit fluid in the groove to lubricate the bearing.

Further in accordance with the invention, the system of groove, passageway, and opening with orifice may be applied to both bearing surfaces of the swashblock when it is intended that the fluid device can be operated with either of its inlet/outlet ports as the high pressure port.

In the preferred embodiment, the arcuate bearing surfaces are portions of a circular cylinder. The groove is generally rectangular and extends over the major portion of the bearing surface. The passageway includes a transverse bore connected to the opening and a pair of inclined holes leading from the bore to the opposite ends of the grooves.

It is a principal object of the invention to provide a positive system for delivering fluid to the swashblock bearing of an axial piston fluid device that uses a lubricated bearing between the mating surfaces of an adjustable swashblock and its support.

It is another object of the invention to provide such a system in which a small metered amount of the fluid is continuously delivered to the interference between the swashblock and the bearing to lubricate the bearing without creating a counterbalancing force that substantially supports the axial load.

The foregoing and other objects and advantages will appear in the following detailed description. In the description, reference is made to the accompanying drawings which show a preferred embodiment of the invention.

DETAILED DESCRIPTION OF THE PREFERRED EMBODIMENT

Figure 1:
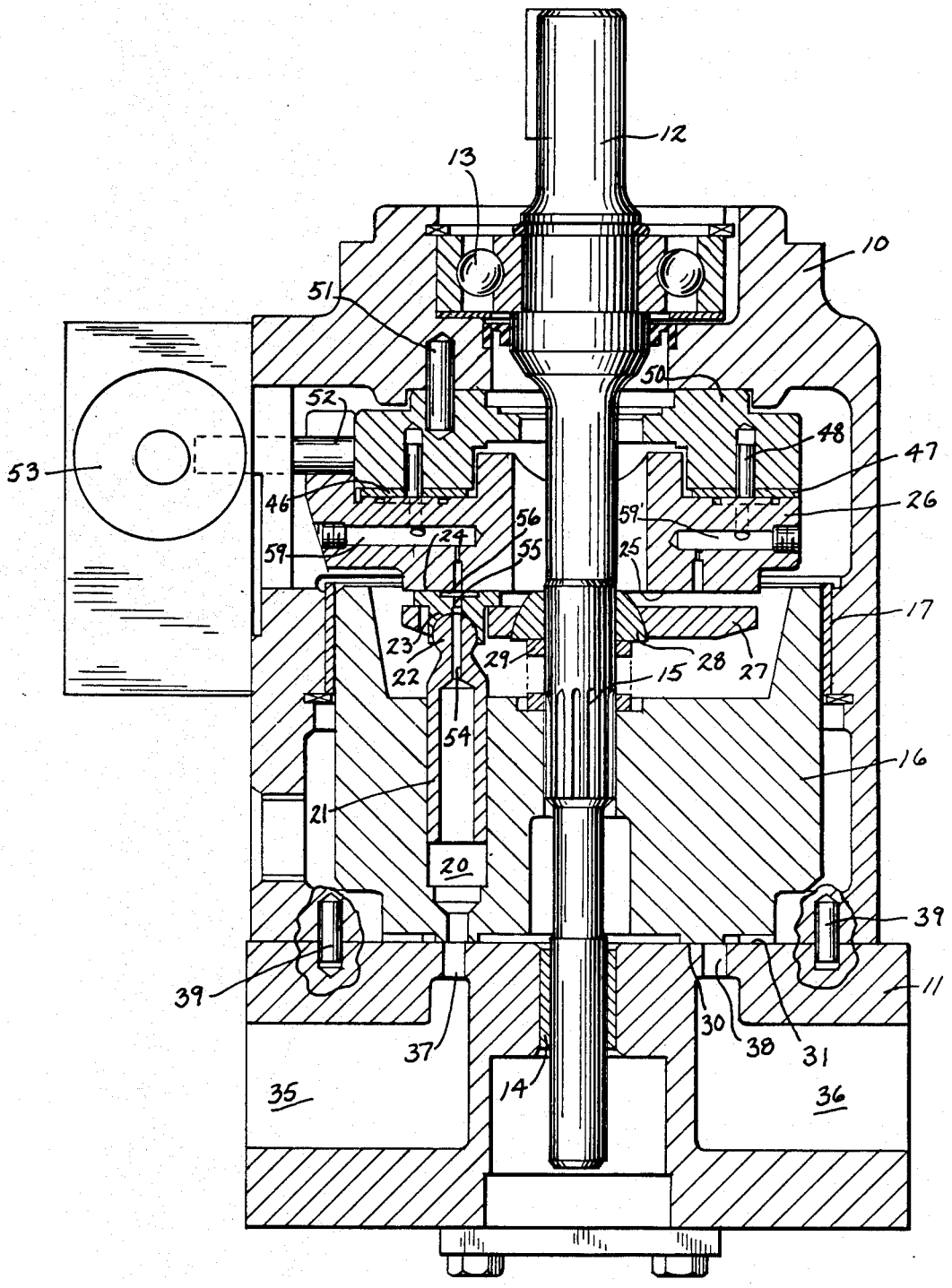
FIG. 1 is a view in section along the longitudinal axis of a pump or motor using the lubrication system of the present invention.

The invention is illustrated as incorporated in an axial piston pump of the general type shown in U.S. Pat. No. 4,167,895, issued Sept. 18, 1979, and assigned to the assignee of this invention. The arrangement of the basic pump elements and their operation is well known in the art. In general, the pump includes a hollow housing 10 open at one end and closed by a flanged valve plate 11. A drive shaft 12 is supported in a shaft ball bearing 13 at the closed end of the housing 10 and in a sleeve bearing 14 mounted in the valve plate 11. The shaft 12 has a medial spline 15 that mates with a spline on a rotatable cylinder barrel 16. The barrel 16 rotates in a barrel sleeve bearing 17 mounted along an inner diameter of the housing 10.

The barrel 16 is formed with a plurality of parallel, axially directed cylinders 20 each of which contains a hollow piston 21. Each piston 21 has a spherical ball 22 at one end which mounts a shoe 23 that is swagged to the piston ball 22 but is free to pivot on the ball. The shoes 23 have flat faces 24 that bear against the flat front face 25 of a swashblock 26. The shoes 23 as a group are held in a shoe retainer plate 27 mounted on a half ball 28 surrounding the shaft 12. A compression spring 29 is trapped between the barrel 16 and the half ball 28. The spring 29 urges the shoe retainer plate 27 and shoes 23 against the swashblock front face 25. The spring 29 also urges a valve surface 30 of the barrel 16 against a porting surface 31 of the valve plate 11.

The valve plate 11 includes an inlet 35 and an outlet 36 each of which leads to a crescent shaped inlet port 37 and outlet port 38. The inlet port 37 is aligned to communicate with the open ends of the cylinders 20 during a portion of one rotation of the barrel 16 and the cylinders 20 communicate with the outlet port 38 during another portion of the rotation. The valve plate 11 is radially aligned on the housing 10 by roll pins 39.

Figure 2:
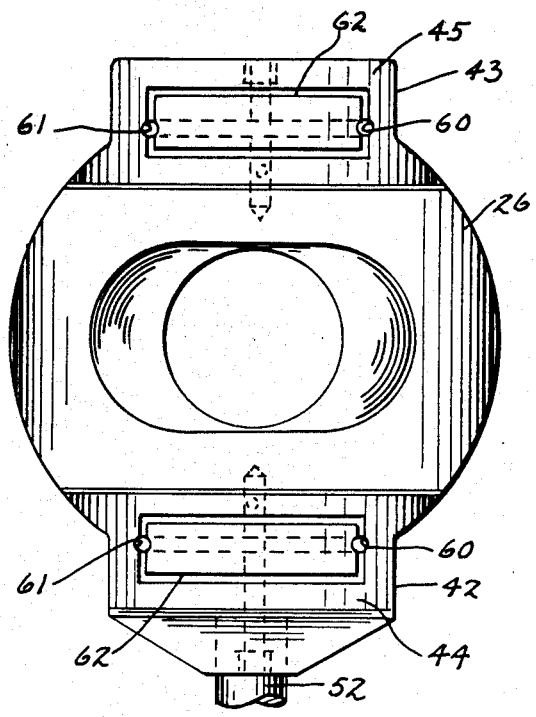
FIG. 2 is a view in elevation of the rear of the swashblock of the device of FIG. 1.
Figure 3:
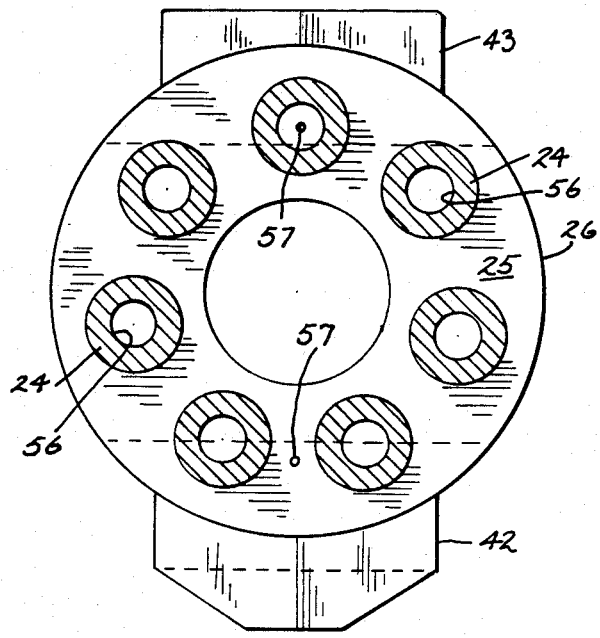
FIG. 3 is a view in elevation of the front of the swashblock with the outline of the piston shoes superimposed on the flat front face of the swashblock.
Figure 4:
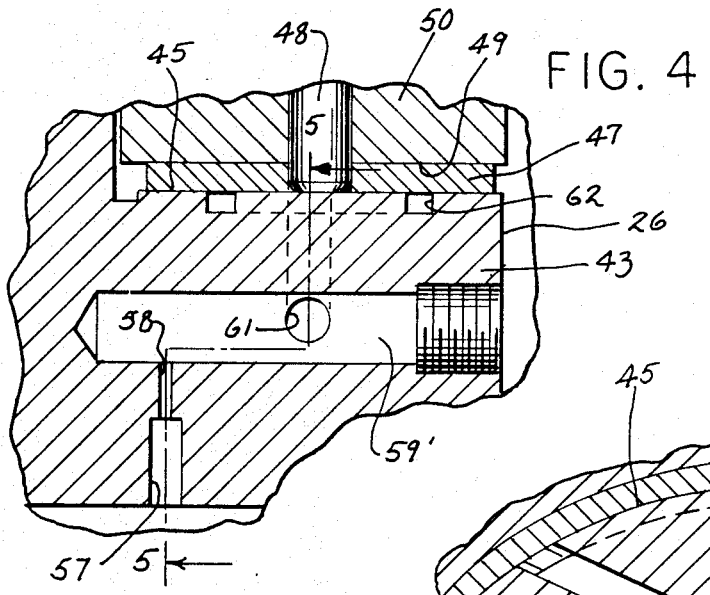
FIG. 4 is a view in section to an enlarged scale illustrating fluid passages forming a portion of the lubricating system.
Figure 5:
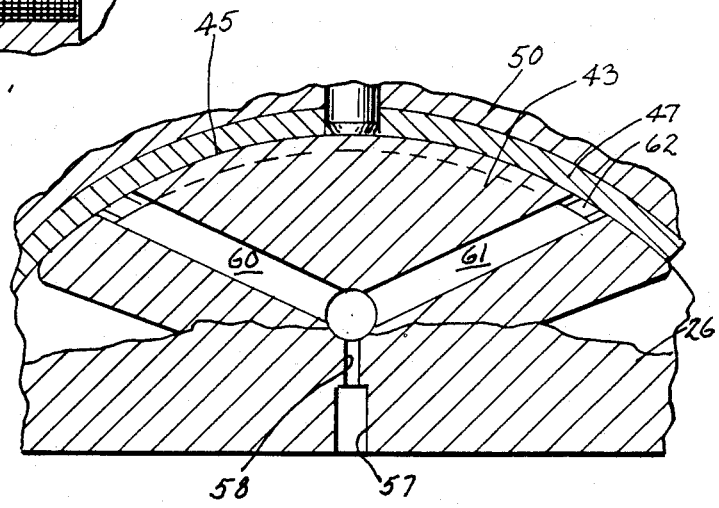
FIG. 5 is a view in section taken in the plane of the line 5—5 of FIG. 4.

As shown in FIGS. 2 and 3, the swashblock 26 has arms 42 and 43 projecting from opposite ends. Each of the arms 42 and 43 has a partial circular cylindrical bearing surface 44 and 45 at its rear. The bearing surfaces 44 and 45 abut against partial sleeve bearings 46 and 47 held by roll pins 48 upon circular cylindrical surfaces 49 in a saddle 50 that supports the swashblock 26. The saddle 50 is held against the closed end of the housing 10 and is located by a pin 51. One swashblock arm 42 mounts a control rod 52 that is engaged by a control piston 53 that can rotate the swashblock 26 on the bearings 46 and 47 to thereby vary the angle of inclination of the swashblock face 25 relative to a plane normal to the axis of the shaft 12. The operation of the control piston 53 is more fully explained in the aforesaid U.S. Pat. No. 4,167,895.

Rotating the drive shaft 12 rotates the cylinder barrel 16. When the control piston 53 is in neutral, the face 25 of the swashblock 26 is normal to the axis of the shaft 12 and the pistons 21 will not be moved as their shoes slide over the swashblock face 25. However, if the control piston 53 moves the swashblock 26 so that the face 25 is at an angle, the pistons will be caused to reciprocate when they revolve around the face 25 of the swashblock. As each piston 21 moves past the inlet port 37, it will move outwardly of the barrel 16 and will draw fluid into its cylinder until it reaches its outermost stroke at which time its cylinder will be blocked since it will have passed beyond the crescent inlet port 37. Each cylinder 20 will then in turn be opened to the outlet port 38 and the pistons 21 at that time will be stroked inwardly to displace fluid from the cylinder 20 into the outlet port 38 until the cylinder is again blocked as it passes beyond the crescent outlet port 38. In this manner, fluid is continuously pumped from the inlet to the outlet. The volume of fluid will depend upon the angle of the swashblock and the resulting length of each stroke of the pistons. The device may also function as a motor by forcing fluid under pressure into the inlet.

Because the faces 24 of the shoes 23 continuously slide over the surface 25 of the swashblock 26 during operation, it is important to lubricate the faces 24. This is typically accomplished by allowing fluid in the cylinders 20 to pass through the hollow pistons 21 and through connecting passages 54 and 55 in the ball 22 and shoe 23, respectively, into a central recess 56 in the shoe face 24.

When pressure is produced or applied at a port 37 or 38, the pistons in the half of the cylinder barrel 15 associated with that port are pressurized. This results in an axial force being transmitted through the shoe faces 24, to the swashblock 26, and into the associated swashblock bearing 46 or 47. For example, when high pressure is applied to the port 38, almost the entire axial force is transmitted into swashblock bearing 47 behind the bearing surface 45 of the arm 43.

The bearings 46 and 47 are typically formed of a synthetic material, such as a composite of tetrafluoroethylene and fiberglass, which is capable of carrying the full axial load. However, such materials exhibit a significant difference in their coefficient of friction depending upon whether the bearings are wet or dry. When the unit is not under pressure, fluid within the housing 10 is able to wet the surface of the bearings 46 and 47 and this enables the control piston 53 to stroke with a low control force. However, if the unit is run with continuous pressure maintained on one port or the other, the axial forces tend to force the fluid film out from between the swashblock bearing surface and the bearing. This results in the bearing running dry, with associated higher control forces being required to move the swashblock. These control forces are then of such magnitude as to be detrimental to various areas of the control and control linkages, particularly in cases where the control is regularly cycled to vary the fluid being displaced. The purpose of the present invention is to provide fluid across the swashblock bearing surfaces 44 and 45 and the bearings 46 and 47 to insure that the bearings 46 and 47 do not run dry.

Referring particularly to FIGS. 2–5, the swashblock 26 is provided with a pair of small openings 57 which extend axially from the front face 25 of the swashblock 26 and which are aligned along a transverse line of symmetry of the swashblock. The openings 57 each include an orifice 58 and the openings 57 each lead to a passageway that includes a cross bore 59, 59' extending from a lateral end of each arm 42 and 43. The passageways are completed by pairs of holes 60 and 61 which branch outwardly from the cross bores 59, 59' in a Y shape and empty into opposite ends of continuous, rectangular grooves 62 formed in each of the swashblock bearing surfaces 44 and 45.

FIG. 3 illustrates seven piston shoes 23 superimposed upon the front face 25 of swashblock 26. Other members of shoes are also used. As each shoe 23 slides over the face 25, during a portion of its movement it will have its central recess 56 in communication with an opening 57. At other times, both before and after communication, the face 24 of each shoe 23 will block the openings 57. At still other times during a complete revolution, the openings 57 will be exposed simply to the unpressured fluid environment within the housing 10. When an opening 57 is exposed to the central recess 56 in a shoe 23 of a piston 16 on the pressure side of the pump, the fluid being pumped will be forced through the hollow piston 16 and the connecting passages 54 and 55 in the piston ball and shoe into the recess 56 in the shoe 23 and then into the opening 57. When the opening 57 is blocked, whatever fluid has been forced into the opening will be held under pressure. When the opening 57 is open to the interior of the housing, all pressure is relieved. The result is a constant pumping action of fluid into the opening 57 in the face of the swashblock 26 on the pressure side of the pump. The fluid is forced through the orifice 58, which limits the amount of fluid which can be bled from the shoe face, and the fluid passes through the passageway formed by the bore 59, 59' and holes 60 and 61 to the rectangular groove 62. The fluid in the groove 62 is distributed over the cooperating bearing 46 or 47.

This lubrication system insures a wetted surface on the loaded bearing 46 or 47, and allows the bearing to then operate at the wet coefficient of friction thereby resulting in the minimum attainable control forces being present.

Although an opening 57 with orifice 58, passageway and lubrication groove 62 are associated with each end of the swashblock 26, only one will be operative at any one time to provide fluid under pressure to a swashblock bearing. The opening 57 which is operative will be that which is associated with the high pressure port of the pump. The other bearing not under load will be wetted by the fluid within the body of the housing. Therefore, the swashblock bearing that is carrying the majority of the axial load is selected for high pressure lubrication. Furthermore, the ability of the lubrication grooves 62 to supply fluid to the surface is proportional to the pressure at the high pressure port. The greater the pressure, the greater will be the need for lubrication and the greater will be the quantity of fluid delivered to a groove 62.

In fluid devices that will operate in only one direction with only one high pressure port, only one opening 57 with its associated orifice, passageway and groove need be provided.

What is claimed is:

1. In a variable displacement fluid device having a housing with a high pressure port and a low pressure port, a rotatable cylinder barrel journaled in the housing and including a plurality of cylinders each having a piston that pivotally mounts a shoe that slides over a front face of a swashblock, the pistons and shoes having cooperating passages that lead from the cylinder to the front face of the swashblock to provide fluid from the cylinders to lubricate the front face of the swashblock, the swashblock having a pair of rear arcuate bearing surfaces, a support in said housing for the swashblock bearing surfaces, a pair of arcuate bearings disposed against said support and engaged by the swashblock bearing surfaces, and means for pivoting the swashblock over the surface of the bearings to vary the angle of the front face of the swashblock, the improvement wherein:

the one swashblock bearing surface of said swashblock that is opposite the high pressure port is formed with a continuous groove that faces the respective bearing, a passageway is formed internal of the swashblock and terminates in the groove, and an opening including an orifice is provided in the swashblock leading to the passageway from a position on the front face of the swashblock that is axially aligned with said one bearing surface and in the path of the shoes, whereby a small, controlled amount of fluid from the passages in the pistons and shoes will be pumped into the opening, through the orifice, and into the passageway to deposit fluid in the groove to lubricate said respective bearing.

2. A fluid device in accordance with claim 1 wherein said arcuate bearing surfaces are each formed as a portion of a circular cylinder and said groove is generally rectangular in shape and extends over the major portion of the one bearing surface.

3. A fluid device in accordance with claim 2 wherein said passageway includes a transverse bore connected to the opening and a pair of inclined holes leading from the bore to opposite ends of the rectangular groove.

4. In a variable displacement fluid device having a housing with a fluid inlet and a fluid outlet, a rotatable cylinder barrel journaled in the housing and including a plurality of cylinders each having a piston that pivotally mounts a shoe that slides over a front face of a swashblock, the pistons and shoes having cooperating passages that lead from the cylinder to the front face of the swashblock to provide fluid from the cylinders to lubricate the front face of the swashblock, the swashblock having a pair of rear arcuate bearing surfaces, a support in said housing for the swashblock bearing surfaces, a pair of arcuate bearings disposed against said support and engaged by the swashblock bearing surfaces, and means for pivoting the swashblock over the surface of the bearings to vary the angle of the front face of the swashblock, the improvement wherein:

each of the swashblock bearing surfaces is formed with a continuous groove that faces the respective bearing, a pair of passageways are formed internal of the swashblock and each passageway terminates in a respective groove, a pair of openings each including an orifice are provided in the swashblock each leading to a respective one of the passageways from a position on the front face of the swashblock that is axially aligned with a bearing surface and located in the path of the shoes.

5. A fluid device in accordance with claim 4 wherein said arcuate bearing surfaces are each formed as a portion of a circular cylinder and said grooves are each rectangular in shape and extend over the major portion of the respective bearing surface.

6. A fluid device in accordance with claim 5 wherein said passageways each include a transverse bore connected to the opening and a pair of inclined holes leading from the bore to opposite ends of the respective rectangular groove.

* * * * *